United States Patent [19]

Wild

[11] Patent Number: 4,572,758

[45] Date of Patent: Feb. 25, 1986

[54] MACHINERY AND METHOD FOR ATTACHING DRINKING STRAWS IN PROTECTIVE COVERINGS TO BEVERAGE CONTAINERS

[75] Inventor: Rudolf Wild, Heidelberg-Eppelheim, Fed. Rep. of Germany

[73] Assignee: Indag Gesellschaft fur Industriebedarf mbH, Heidelberg-Eppelheim, Fed. Rep. of Germany

[21] Appl. No.: 687,212

[22] Filed: Dec. 28, 1984

[30] Foreign Application Priority Data

Feb. 13, 1984 [DE] Fed. Rep. of Germany ..... 3401214

[51] Int. Cl.[4] ..... B32B 31/00

[52] U.S. Cl. ..... 156/256; 53/128; 53/410; 156/264; 156/521

[58] Field of Search ..... 156/256, 264–265, 156/510–512, 515–521, 571, 560–561, 530, 528, 559; 53/410, 128

[56] References Cited

U.S. PATENT DOCUMENTS

| | | | |
|---|---|---|---|
| 2,627,212 | 2/1953 | Connor et al. | 156/256 X |
| 4,210,484 | 7/1980 | Crankshaw | 156/542 |
| 4,384,915 | 5/1983 | Utsumi | 156/521 X |

*Primary Examiner*—David Simmons

*Attorney, Agent, or Firm*—Kaplan, Blum, Friedman, Silberman & Beeran

[57] ABSTRACT

A straw attachment apparatus for attaching drinking straws to beverage containers. A carrier member has a first and a second surface. The carrier member supports a plurality of straws in substantially parallel alignment with each other on the first surface of the carrier. An adhesive is secured to the second surface of the carrier member and a container assembly supplies a plurality of beverage containers into registry with the adhesive on the second surface of the carrier member so that the straws are adhesively secured to the beverage containers.

50 Claims, 5 Drawing Figures

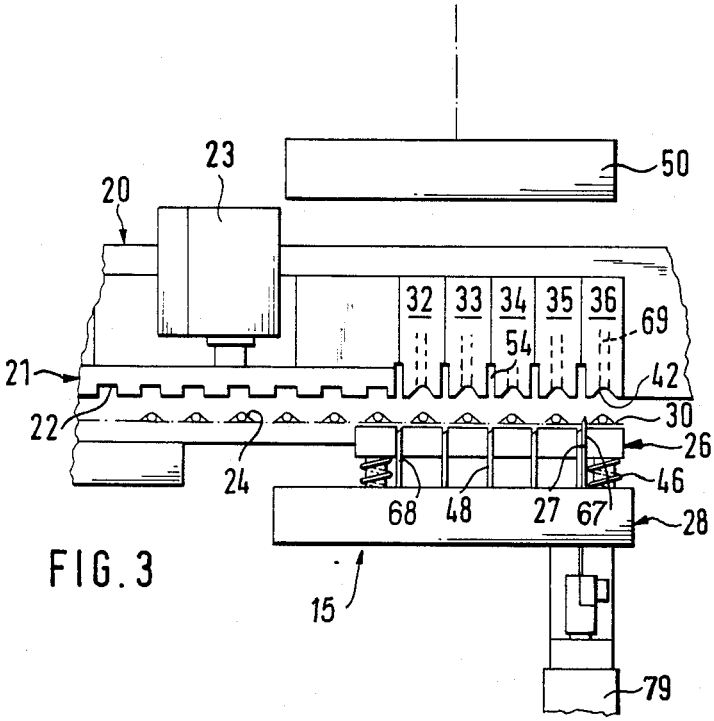
FIG. 3
FIG. 4
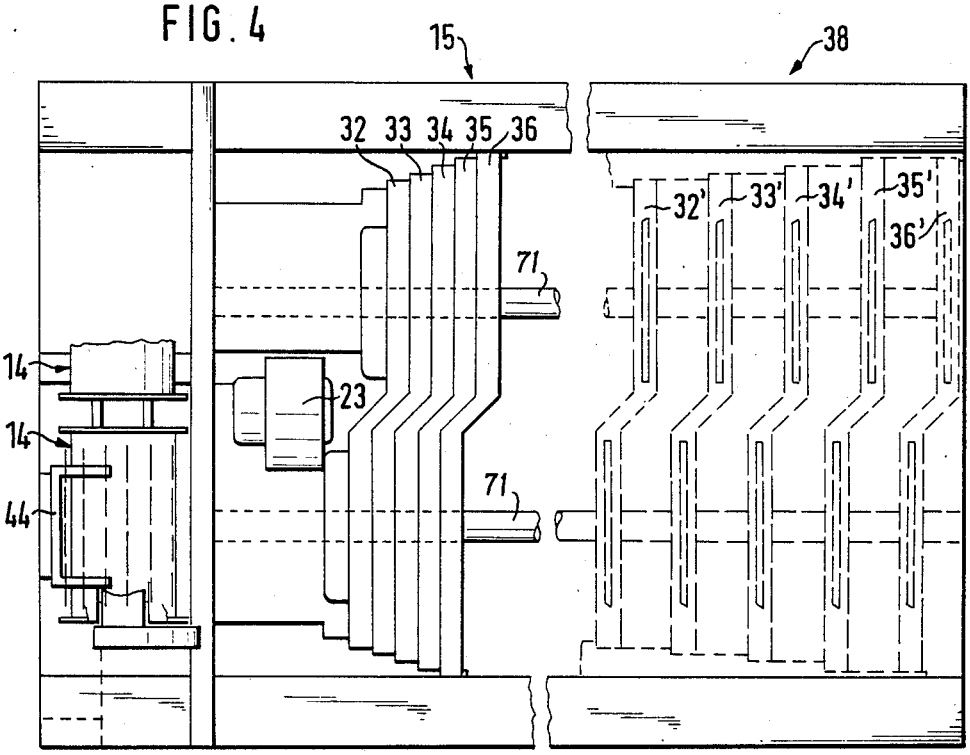

MACHINERY AND METHOD FOR ATTACHING DRINKING STRAWS IN PROTECTIVE COVERINGS TO BEVERAGE CONTAINERS

BACKGROUND OF THE INVENTION

The invention is generally directed to a method and apparatus for the attachment of a drinking straw wrapped in a protective covering to a beverage container and in particular to the batch attachment of a plurality of drinking straws wrapped in protective coverings and formed in a roll to a plurality of beverage containers. Wrapped drinking straws are arranged in parallel with respect to each other and each straw is oriented perpendicular to the length of the roll. The roll is provided with an adhesive surface along the lengthwise extension thereof.

It is known to provide drinking straws with a protective covering in the form of a tape where the drinking straws are parallel to and substantially equidistant from each other, and perpendicular to the length of the tape. One known process separates a single drinking straw and its protective covering, hereinafter referred to as a straw package, from the straw package tape and sticks one straw at a time onto a prepared sticking spot on the side of a beverage container.

An apparatus and method for affixing a straw package onto a beverage container one straw at a time is disclosed in DE-OS No. 29 02 899. A dispenser reel holds a tape with straw packages. One straw package at a time is separated from the tape and affixed to the side of a beverage container that is transported by a mechanism that is separate from the mechanism transporting the straw package.

In the known apparatus the straw package tape is fed over a feeding roll having longitudinal grooves, parallel to the spindle of the roll and recessed within the roll's jacket. The longitudinal grooves are adapted to receive the drinking straws within the straw packages and easily feed the tape around the feed roll. The feed roll is partially covered along the feed path by a lead which extends in an arc around the roll's jacket. In the area of the lead a knife, which is intermittently operated, is applied to the tape to sever individual straw packages from the tape. In the lead-out area of the jacket, utilizing a synchronously intermittent press, one straw package at a time is pressed onto the side of a beverage container, which container is moved to the application spot by a conveyor at the appropriate time.

The straw package is pressed precisely on a spot of adhesive located on the side of the beverage container which adhesive has been applied at a previous processing stage. Because the tape has no adhesive on its surface the straw package must contact the prepared spot of adhesive to assure affixation. This requires very accurate placement of the straw package which slows down the speed of the apparatus process.

The industrial racking off and packing of beverage containers has as an important goal the processing of the largest possible number of beverage containers per unit time. The working rate of the known processes and apparatus is limited by the number of strokes per unit time achievable by the knife used to detach the straw packages from the tape and the press used to press the detached drinking straws onto the prepared spot of adhesive on the wall of the beverage container. To operate the known machinery at a higher rate adds additional stresses and tensions to the equipment causing more frequent breakdowns and a lower resultant yield. Also at higher speeds, the mass forces on the moving parts of the machinery increase greatly, leading to more frequent failures and expensive replacement and curative maintenance. Accordingly, there is a need for a process and the apparatus to implement the process which increases the rate of straw packages affixed to beverage containers without unduly stressing the system.

SUMMARY OF THE INVENTION

Generally speaking in accordance with the instant invention a process and apparatus for attaching drinking straws to beverage containers is provided. Each of the beverage containers are conveyed in batches of a predetermined number and arrangement. A batch of drinking straw packages are substantially simultaneously detached from a tape roll of straw packages, separated into individual straw packages that are properly positioned relative to the beverage containers and affixed to a beverage container. The straw packages are supported on a tape which has an adhesive strip along the lengthwise extent thereo. The adhesive strip permits the straw packages to be affixed to the wall of the beverage containers. The adhesive strip is covered by a covering tape. Before the batch of straw packages are separated the covering tape is peeled off exposing the adhesive strip.

It is an object of the invention to provide an improved apparatus for affixing straws to beverage containers.

Another object of the invention is to provide an improved process for affixing straws to beverage containers.

Yet another object of the invention is to provide an apparatus for batch affixation of a predetermined number and arrangement of drinking straws in protective coverings onto beverage containers.

Still another object of the invention is to provide a process for affixing drinking straws in protective coverings onto beverage containers so that a predetermined number of drinking straws can be secured to a corresponding predetermined number of beverage containers.

A further object of the invention is to provide a process and apparatus for increasing the yield of straws affixed to beverage containers by providing an adhesive on the straw packages.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is an enlarged partial side elevational view of the cutting stage of the apparatus of FIG. 1;

FIG. 4 is a top view of the apparatus of FIG. 1 in both the cutting and sticking stages.

DETAILED DESCRIPTION OF THE PREFERRED EMBODIMENTS

The apparatus and process for affixing straws to beverage containers achieves its efficiency by batch processing. Instead of attempting to optimize the speed of separating individual straw packages from the tape and adhesive straw packages onto a beverage container, a number of straw packages are separated from the tape and each other at one time in a cutting station. This predetermined number of straw packages, hereinafter referred to as a batch, is then conveyed to the adhesive station where the entire batch of straw packages is affixed to a batch of beverage containers at one time. This process is particularly suited to beverage bags which have no drinking spout or opening, like cans or folded paper container bags which require a straw for easy consumption. The tape of straw packages has an adhesive strip on the side to be affixed to the beverage containers. This allows the straw packages to be affixed with broader tolerances to the beverage containers, because it is unnecessary for the straw packages to be in contact with a single prepared spot of adhesive.

Figure 1:
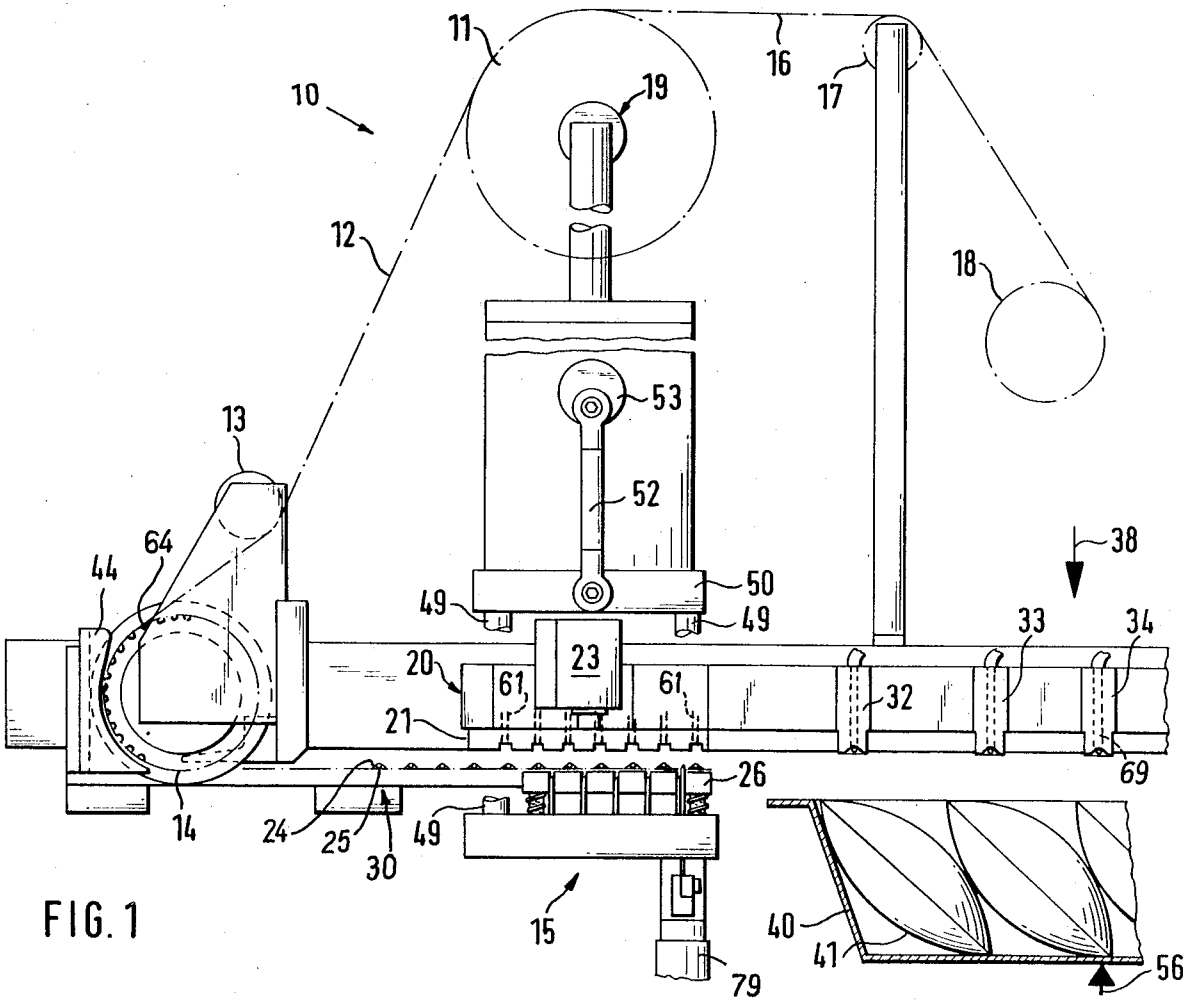
FIG. 1 is a partially cut away side elevational view of an apparatus for affixing drinking straws to beverage containers constructed in accordance with the invention.
Figure 5:
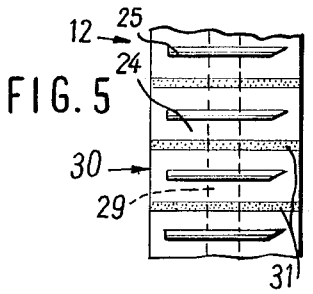
FIG. 5 is a partial top plan view of the tape of drinking straw packages.

Reference is made to FIG. 1 wherein an apparatus in accordance with a preferred embodiment of the invention is depicted. A dispenser roll 11 of a drinking straw package tape 12 is rotatably mounted on a spindle 19. As shown in FIG. 5, drinking straw package tape 12 is composed of a series of drinking straw packages 30 each of which has a drinking straw 25 inside a protective covering 24. Drinking straws 25 are oriented perpendicular to the length of tape 12. In addition, each of the adjacent straws 25 are parallel to and equidistant from each other so that a regular pattern of drinking straw packages 30 make up tape 12. There is a cutting region 31 between each adjacent straw 25, where tape 12 can be cut without opening the protective cover 24.

An adhesive strip 29 is positioned about midway across the width of tape 12 and extends along the length of tape 12. Adhesive strip 29 is covered by a covering tape 16 along the lengthwise extent thereof so that tape 12 does not stick to itself when the tape is wound in a roll for storage and handling.

Tape 12 is unwound from roll 11 and is conveyed to a cutting station 15 where a batch of straw packages are separated over a guide roll 13 and a feeding roll 14. As tape 12 moves off roll 11 and toward guide roll 13 and feeding roll 14, covering tape 16 is peeled away in the opposite direction to a takeup reel 18 over a guide roll 17. In this way as tape 12 is unwound from roll 11 adhesive strip 29 is exposed.

Guide roll 13 has a groove (not shown) around its circumference to prevent contact with adhesive strip 29 which could cause undesired adhesion of tape 12 to guide roll 13. Feeding roll 14 has a series of longitudinal grooves 64 corresponding in size to drinking straws 25. Longitudinal grooves 64 are parallel to the rotational axis of feeding roll 14. Grooves 64 allow feeding roll 14 to grip tape 12 and smoothly feed tape 12 toward cutting station 15.

Figure 2:
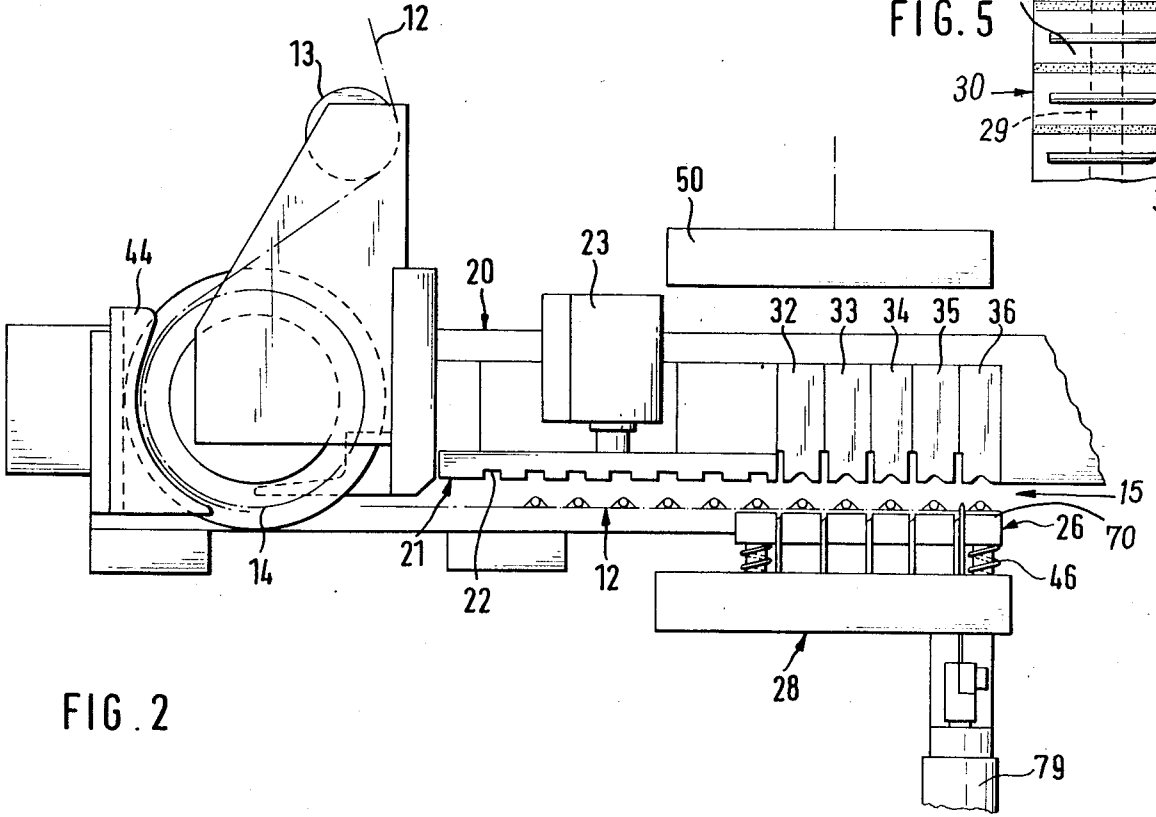
FIG. 2 is an enlarged partial side elevational view of the apparatus of FIG. 1.

A feeding block 20 moves tape 12 between feeding roll 14 and cutting stage 15. Feeding block 20 is movable from an initial position (FIG. 3), to cutting station 15 (FIGS. 1 and 2). Feeding block 20 is equipped with a driver disk 21 on its bottom surface. Driver disk 21 has grooves 22 corresponding in size and position to straws 25 on tape 12. Takeup grooves 22 have intake nozzles 61 which are connected to a vacuum which attracts and holds individual straw packages 30 within individual takeup grooves 22. Feeding block 20 is also vertically movable over a limited range of motion. Feeding block 20 is raised and lowered by an operating cylinder 23 (FIGS. 2, 3).

Operating cylinder 23 lowers feeding block 20 and driver disk 21 toward the leading edge of straw packages 30. When driver disk 21 is lowered, grooves 22 align with the upwardly extending regions of tape 12 corresponding to individual straws 25 covered by protective coverings 24. Intake pressure is applied through intake nozzles 61 in grooves 22 firmly gripping individual straw packages 30.

With the leading several straw packages 30 gripped within takeup grooves 22, the front end of tape 12 is advanced to the cutting station 15 (FIG. 1) as feed block 20 is moved to the right. Leading straw packages 30 of tape 12 are positioned above a cutting disk 26 within cutting station 15. Tape 12 is held in place by a piercing means 27 located within a vertical slot 67 which pierces tape 12 in region 31 between the two leading straw packages 30 (on the right in FIG. 1), and holds tape 12 stationary for the cutting process. While only one piercing means 27 is shown it is also possible to have multiple piercing means 27 which grasp near the side edges of tape 12. Piercing means 27 is raised and lowered in a substantially vertical orientation by an operating cylinder 79. Operating cylinder 79 can be a hydraulically operated cylinder which is synchronously triggered to move piercing means 27 up and down.

Cutting disk 26 has longitudinally oriented slots 68 aligned with regions 31 between adjacent straw packages 30. A top surface 70 of cutting disk 26 has a longitudinal groove corresponding to the placement of adhesive strip 29 to avoid adhesion of tape 12 to the machinery. A knife disk 28 is located below cutting disk 26 and supports several separating knives 48 which are fastened to knife disk 28. Knives 48 are vertically movable within longitudinal slots 68 with leading knife 48 movable within slot 67 along with piercing means 27. The positioning of knives 48 and slots 67, 68 is such that when the leading edge of tape 12 is fixed by graver 27 above top surface 70 of disk 26, knives 48 are positioned below regions 31 in preparation for separating straw packages 30.

The movement of knife disk 28 and, attached knives 48 is controlled by operating disk 50, firmly coupled to knife disk 28 by bars 49. Operating disk 50 is vertically operated by a motor driven eccentric drive 53 having a crank arm 52 which is coupled to operating disk 50.

Knife disk 28 is biased away from cutting disk 26 by springs 46. When upward pressure is exerted on knife disk 28 by operating disk 50, as eccentric drive 53 rotates, cutting disk 28 moves upward toward a series of drivers 32, 33, 34, 35, 36.

Reference is made to FIG. 3 wherein the leading batch of straw packages 30 of tape 12 is in cutting station 15, secured in position on piercing means in preparation for separation of the leading five straw packages 30. In this embodiment a batch is composed of five members. As a result, there is parallel processing of five straw packages 30 and beverage containers 41. A series of five drivers 32, 33, 34, 35, 36 are positioned above the five leading straw packages 30. Drivers 32, 33, 34, 35, 36 have longitudinal curved recesses 42 in their lower surfaces configured to receive the outwardly extending surface of individual straw packages 25, that is the surface without adhesive strip 29. Curved recesses 42 have air intake nozzles 69 connected to a vacuum source (not shown).

The separation of straw coverings 30 is accomplished by the cyclical movement of eccentric drive 53 which causes the upward movement of knife disk 28 which carries cutting disk 26 and the leading edge of tape 12 upward until individual straw packages 30 are firmly held between curved grooves 42 and upper surface 70 of cutting disk 26. When upper surface 30 of cutting disk 26 presses against the lower surfaces of drivers 32, 33, 34, 35, 36 intake pressure is applied through nozzles 69 to more firmly hold individual straw packages 25 in position within circular recesses 42.

As eccentric drive 53 continues its cycle, knife disk 28 and the attached separating knives 48 continue upward because of springs 46 after cutting disk 26 has stopped. Knives 48 move upward into recesses 54 between drivers 32, 33, 34, 35, 36. As a result tape 12 is then separated from the leading batch and the leading batch is divided into five separate individual straw packages 30.

An eccentric drive 53 finishes its cycle, knife disk 28 moves downward and knives 48 recede beneath upper surface 70 of cutting disk 26 and cutting disk 26 moves downward away from the lower surface of drivers 32, 33, 34, 35, 36. Piercing means 27 also moves downward freeing itself from region 30 so that it is not extending above upper surface 70 of cutting disk 26. However, individual straw packages 30 are still held firmly within recesses 42 by the intake pressure exerted through nozzles 69.

After the cutting process is completed movable drivers 32, 33, 34, 35, 36 move to the right (FIG. 1) along longitudinal leads 71 to affixing station 38. As drivers 32, 33, 34, 35, 36 move to the right (FIG. 1), they separate from each other so as to align with beverage bags 41. Beverage bags 41 are situated in an open-top container 40 in a predetermined arrangement. The final lateral positions of drivers 32, 33, 34, 35, 36 are predetermined by stops (not shown). As soon as drivers 32, 33, 34, 35, 36 reach their fully separated position (FIG. 1), open package 40 containing arranged beverage bags 41 is lifted by means of a lifting and conveying mechanism 56. Lifting and conveying mechanism 56 presses the upper exposed surfaces of beverage bags 41 against the side or protective coverings 24 having exposed adhesive strip 29. Straw packages 25 are then adhesively secured to beverage bags 41 by adhesive strip 29. Substantially simultaneously the intake air supply to bottom rounded grooves 42 through bores 69 is cut-off. As open package 40 is lowered from drivers 32, 33, 34, 35, 36 straw packages 30 remain secured to beverage bags 41 and are then conveyed away from affixing station 38 by conveyor system 56.

While the machinery is shown set up to handle batches of five straw packages at one time batches of other sizes can be used. The time saving efficiency is obtained with batches as small as two straw packages being processed at one time. However, larger batches such as five or six show radical increases of efficiency over known process machinery.

Reference is next made to FIG. 4 wherein an alternate embodiment of an apparatus for affixing straws to beverage containers constructed in accordance with the invention is depicted. The embodiment of FIG. 4 is configured to simultaneously transport two rolls 11 of drinking tape 12. Feed block 20 and drivers 32, 33, 34, 35, 36 are configured for parallel operation. As a result of parallel operation, batches of ten are processed at one time. This is particularly useful where a complete commercial package can have its straw packages affixed with all the beverage containers already in part of the final packaging.

Container 40 used to house beverage bags 41 is a shell-shaped folding container in which one half of beverage bags 41 are arranged in a position as shown in FIG. 1 and the other half of beverage bags 41 are arranged slanting in the opposite direction. This configuration of beverage bags 41 in package 40 requires a staggered arrangement of drivers 32, 33, 34, 35, 36 as depicted in FIG. 4. Apart from these adaptations necessary for parallel processing, the apparatus attaches drinking straw packages onto beverage containers in the same manner and utilizes the same functional parts as the apparatus described above but with a doubled yield.

As noted above, each of the handling surfaces of the machinery which are in contact with the side of tape 12 with adhesive strip 29 have grooves running in the same direction as adhesive strip 29 so that tape 12 does not stick to any part of the machinery. Parts that have a groove to avoid contact in adhesive strip 29 include fairlead 13, upper surface 70 of cutting disk 26 and the interior of conveyor housing 44 encircling a portion of feeding roll 14.

The process for batch affixation of drinking straws onto beverage containers in accordance with the invention affixes a batch of drinking straws in protective packages to beverage containers and in particular beverage bags.

The process requires a tape of straw packages having an adhesive strip on one surface of the tape with a protective covering over the adhesive strip. As the tape is removed from the roll the protective covering is also removed. The leading edge of the tape is transported to cutting station 15 by guide roll 13, leading roll 14 and feed block 20 having driver disk 21 with grooves 22.

The leading edge of tape 12 is secured in cutting station 15 by piercing means 27 and is then separated into individual straw packages 30 by knives 48. Separated straw packages 30 are then transported to affixing station 38 by drivers 32, 33, 34, 35, 36 within grooves 42.

In affixing station 38 the separated drinking straw packages 30 are held with the side having the piece of adhesive strip 29 exposed. A batch of beverage containers 41 is then raised into contact with exposed adhesive strip 29. Beverage containers 41, with affixed straw packages 30, are then removed from affixing stage 38.

A significant increase in efficiency of processing is achieved by simultaneously detaching a predetermined number of drinking straws from the tape and then simultaneously sticking the predetermined number of drinking straws onto corresponding beverage containers. The increase in efficiency over the known process which affixes one drinking straw package at a time directly corresponds to the number of straw packages and beverage containers in each batch. Therefore, if five straw holders are detached at one time the rate of processing is increased by about a factor of five over the known process.

Further increases in speed and efficiency are achieved in accordance with the invention by having an adhesive strip on the protective covering enclosing the drinking straws. Because the prior art has the adhesive fixed to a predetermined sticking spot on a beverage container, rather than on the straw package, the placement of the straw package on the beverage container becomes critical. Here, however, because the adhesive is on the straw package the precise placement of the straw package on the beverage container is not crucial. It is much easier to quickly place the drinking straw packages on the sides of a beverage container by merely contacting the straw package, having the adhesive, with any exposed surface of a beverage container, with slight pressure.

The present invention also decreases the stress on the equipment because of the inherent efficiency of the process. Because increases in processing are on the order of five to ten times the processing rate of the prior art, the machinery can be operated at a slower speed then the prior art machinery, while maintaining the substantial time saving benefits of the invention. As a result, the wear on the individual machine parts is significantly reduced because of reduced stresses, and specifically reduced mass forces resulting in the prior art process from required rapid changes in direction. The reduced wear on the individual machine parts increases the life of the machinery and the time between breakdowns and major maintenance.

While intake nozzles 61, 69 are an efficient way of assuring the grasping of the drinking straw tape at various stages in the process other methods can also be used in accordance with the invention.

Drivers 32, 33, 34, 35, 36, as noted above, move from a first position in the cutting stage to a second position in the affixing stage. In the cutting stage the drivers are substantially abutting so as to receive individual straw packages from the tape. However, as the drivers move to the affixing stage, running along guide rods 71, the proper positioning of the drivers is achieved by having stops which are precisely placed so that the final positions of drivers 32, 33, 34, 35, 36 are directly above individual beverage bags 41.

Another important feature of the invention is that the beverage containers are conveyed to the affixing stage in an open packing. This open packing can be the retail container for a plurality of beverage containers, thereby further increasing the efficiency of the process in an overall production system.

Accordingly, an apparatus and process for the batch affixation of drinking straws in protective coverings onto beverage containers is provided. The apparatus and process increase the speed and efficiency of affixing drinking straws in protective packages to beverage containers from a tape of drinking straw packages. The simultaneous detachment from the tape of a batch of straw packages and simultaneous affixation of a batch of straw packages to the beverage containers significantly increases speed and efficiency. An adhesive strip on the surface of the straw package decreases the criticality of placement of the straw packages on the beverage containers. The increase in efficiency resulting from batch processing permits the machinery to be operated at a lower speed thereby decreasing machine part wear and mechanical breakdowns.

It will thus be seen that the objects set forth above, among those made apparent from the preceding description, are efficiently attained and, since certain changes may be made in carrying out the above process and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A process for attaching a batch of drinking straws in straw packages on a tape of drinking straw packages with the drinking straws substantially parallel and substantially equidistant from each other and substantially perpendicular to the length of the drinking straw package tape to beverage containers, comprising:

supplying a batch of drinking straws on a tape, each drinking straw enclosed in a protective covering;

exposing an adhesive on one surface of the tape;

conveying a batch, comprising a predetermined number greater than one, of the drinking straw packages on the tape to a cutting station;

detaching the batch of drinking straw packages from the tape and each other substantially simultaneously;

conveying the batch of separated straw packages to an affixing station; and affixing the batch of separated drinking straw packages to a batch of beverage containers substantially simultaneously.

2. The process of claim 1 wherein the drinking straw tape is supplied by unrolling a rotating roll.

3. The process of claim 1 wherein the adhesive on one surface of the tape is exposed by removing a covering strip before the batch of drinking straw packages are conveyed to the cutting station.

4. The process of claim 3 wherein the covering strip is removed by pulling the covering tape in substantially the opposite direction that the tape is supplied to.

5. The process of claim 3 wherein the covering strip is removed from the adhesive by guiding the cover strip over a guide roller and rolling it onto a take-up roll, substantially opposite the direction in which the tape is supplied.

6. The process of claim 1 wherein conveying a batch of the drinking straw packages on the tape to the cutting station comprises guiding the tape around guide rolls, gripping individual straw packages and transporting the gripped straw packages to the cutting stage.

7. The process of claim 6 wherein the individual straw packages are held in the grooves by attracting the straw packages to grooves with a vacuum in a feed block.

8. The process of claim 7 wherein the batch of straw packages are transported to the cutting station by moving the feed block so that the batch on the leading edge of the tape is in the cutting station.

9. The process of claim 1 wherein the batch of drinking straw packages are detached from the tape and each other substantially simultaneously by securing the batch of drinking straw packages at the leading edge of the tape in the cutting station; gripping the individual straw packages of the batch at the leading edge of the tape in driver heads; and cutting the individual straw packages in the batch from the other individual straw packages in the batch at the leading edge of the tape and the rest of the tape.

10. The process of claim 9 wherein the batch at the leading edge of the tape is secured by piercing the tape with a piercing means between the leading straw package and the adjacent straw package.

11. The process of claim 9 wherein the driver heads grip the batch of straw packages at the leading edge of the tape by adhering the packages to grooves in the drivers adapted to receive the drinking straws within the straw packages.

12. The process of claim 9 wherein the batch of drinking straw packages at the lead edge of the tape are cut at substantially the same time by cutting with a cutting disk having multiple knives.

13. The process of claim 1 wherein the batch of separated straw packages are conveyed to the affixation station by moving the drivers from the cutting stage to the affixation station.

14. The process of claim 1 wherein the batch of separated drinking straw packages are affixed to a batch of beverage containers by biasing the beverage containers against the exposed adhesive on each drinking straw package.

15. A batch separator and affixer of drinking straws in drinking straw packages to beverage containers, said drinking straw packages being on a drinking straw package tape with the drinking straws substantially parallel and substantially equidistant from each other and perpendicular to the length of the drinking straw package tape, said batch separator and affixer comprising:

supplying means for supplying a batch of packages at the leading edge of the tape of drinking straw packages to a cutting station;

cutting means in the cutting station for substantially simultaneously separating the drinking straw packages in the batch at the leading edge of the tape from the tape and each other;

conveying means for moving the separated batch of drinking straw packages from the cutting station to an affixing station; and affixing means for affixing the separated batch of drinking straw packages in the affixing station to a batch of beverage containers.

16. The batch separator and affixer of claim 15, wherein the affixing means comprises an adhesive on one surface of the tape.

17. The batch separator and affixer of claim 15, wherein the supplying means comprises directing means for controlling the movement of the tape and driving means for selectively gripping the leading edge of the tape from the directing means and transporting the gripped tape to the cutting station.

18. The batch separator and affixer of claim 17, wherein the directing means comprises a guide roll and a feeding roll.

19. The batch separator and affixer of claim 18, wherein the feeding roll has grooves oriented substantially parallel to the axis of rotation of the feeding roll around the circumference of the feeding roll wherein said grooves are adapted to receive the straws in the straw packages on the tape.

20. The batch separator and affixer of claim 16, wherein the supplying means comprises directing means for controlling the movement of the tape and driving means for selectively gripping the leading edge of the tape from the directing means and transporting the gripped tape to the cutting station.

21. The batch separator and affixer of claim 20, wherein the directing means comprises a guide roll and a feeding roll.

22. The batch separator and affixer of claim 21, wherein the feeding roll has grooves oriented substantially parallel to the axis of rotation of the feeding roll around the circumference of the feeding roll wherein said grooves are adapted to receive the straws in the straw packages on the tape.

23. The batch separator and affixer of claim 22, wherein the feeding roll further has a groove oriented around the circumference of the feeding roll and adapted to prevent the adhesive on the drinking straw package tape from contacting the feeding roll.

24. The batch separator and affixer of claim 16, further comprising protecting means for covering the adhesive on the drinking straw package tape and removing means for selectively removing the protecting means to expose the adhesive.

25. The batch separator and affixer of claim 24, wherein the protecting means comprises a strip which is adapted to peel off of the adhesive and the removing means comprises a guide roll and a take up roll.

26. The batch separator and affixer of claim 17, wherein the driving means comprises a feed block for moving the leading section of the tape to the cutting station and gripping means in the feed block for selectively adhering the leading section of the straw package tape to the feed block.

27. The batch separator and affixer of claim 26, further comprising piercing means for fixing the leading section of the drinking straw package tape in the cutting station.

28. The batch separator and affixer of claim 26, wherein the gripping means comprises intake grooves in the driving head means selectively coupled to vacuum means.

29. The batch separator and affixer of claim 15, wherein the cutting means comprises grabbing means for retaining the batch at the leading section of the tape in the cutting station, clamping means for clamping each of the drinking straw packages in the batch of drinking straw packages at the leading section of the tape, and severing means for severing the clamped drinking straw packages from the tape and each other.

30. The batch separator and affixer of claim 29, wherein the gripping means comprises a movable piercing means adapted to pierce the tape between the drinking straw package at the lead edge of the tape and the drinking straw package adjacent to the drinking straw package at the leading edge of the tape.

31. The batch separator and affixer of claim 29, wherein the clamping means comprises a batch of driving heads wherein each driving head is adapted to receive one surface of a drinking straw package; a cutting disk, having a plurality of slots, opposing said driving heads, sandwiching the batch of drinking straw packages at the leading section of the tape therebetween; and biasing means for selectively biasing the driving heads and the cutting disk towards each other.

32. The batch separator and affixer of claim 31, wherein the severing means comprises a knife disk and a plurality of knives attached to the knife disk positioned below the cutting disk, the plurality of knives being adapted to pass through the slots in the cutting disk and penetrate the drinking straw package tape between adjacent drinking straw packages.

33. The batch separator and affixer of claim 16, wherein the cutting means comprises grabbing means for retaining the batch at the leading section of the tape in the cutting station, clamping means for clamping each of the drinking straw packages in the batch of drinking straw packages of the leading section of the tape, and severing means for severing the clamped drinking straw packages from each other and the tape.

34. The batch separator and affixer of claim 33, wherein the gripping means comprises a movable piercing means adapted to pierce the tape between the drinking straw package at the lead edge of the tape and the drinking straw package adjacent to the drinking straw package at the leading edge of the tape.

35. The batch separator and affixer of claim 33, wherein the clamping means comprises a batch of driving heads, wherein each driving head is adapted to receive one surface of a drinking straw package; a cutting disk, having a plurality of slots, opposing said driving heads, sandwiching the batch of drinking straw packages at the leading section of the tape therebetween; and biasing means for selectively biasing the driving heads and the cutting disk towards each other.

36. The batch separator and affixer of claim 35, wherein the severing means comprises a knife disk and a plurality of knives attached to the knife disk positioned below the cutting disk, the plurality of knives being adapted to pass through the slots in the cutting disk and penetrate the drinking straw package tape between adjacent drinking straw packages.

37. The batch separator and affixer of claim 35, wherein the cutting disk has a groove parallel to the length of the drinking straw package tape in the region of the adhesive on the drinking straw package tape whereby the adhesive on the drinking straw package tape does not contact the cutting disk.

38. The batch separator and affixer of claim 31 wherein the biasing means comprises an eccentric drive coupled between the cutting disk and the drive heads.

39. The batch separator and affixer of claim 15, wherein the conveying means comprises a batch of driving heads, wherein each driving head is adapted to receive one surface of a drinking straw package and means for moving said driving head to the affixing stage.

40. The batch separator and affixer of claim 15, wherein the beverage containers are composite beverage bags.

41. A straw attachment apparatus for attaching drinking straws to beverage containers, comprising:

a plurality of straws;

carrier means having first and second surfaces, said carrier means supporting said straws in substantially parallel alignment with each other on the first surface of the carrier means;

adhesive means secured to said second surface of said carrier means;

conveying means for conveying the plurality of straws to a cutting station;

cutting means for substantially simultaneously separating a plurality of individual straws from the remaining straws on the carrier and positioning means for positioning the individual straws proximate to the container means; and container means for supplying a plurality of beverage containers into registry with the adhesive means on the second surface of the carrier means so that said plurality of straws are adhesively secured to said plurality of beverage containers.

42. The straw attachment apparatus of claim 41, further comprising covering means for enclosing and separating individual straws on the first surface of the carrier means, thereby defining straw packages each of which comprises a straw enclosed within a portion of the carrier and a portion of the covering means.

43. The straw attachment apparatus of claim 41, further comprising protecting means for removably covering the adhesive means.

44. The straw attachment apparatus of claim 42, further comprising protecting means for removably covering the adhesive means.

45. The straw attachment apparatus of claim 44, wherein the carrier means, plurality of straws, enclosing means, adhesive means and covering means are provided as a tape in a rolled form.

46. The straw attachment apparatus of claim 41, wherein the conveying means comprises guide means for directing the movement of the tape and a feed block adapted to grip the tape and advance the tape to the cutting station.

47. The straw attachment apparatus of claim 46, wherein the cutting means comprises gripping means for holding the tape in a fixed position in the cutting station and multiple knife means for substantially simultaneously severing a predetermined number of straw packages from adjacent straw packages and the tape.

48. The straw attachment apparatus of claim 47, wherein the positioning means comprises a predetermined number of drive heads adapted to grip the separated straw packages and transport them proximate to the container means.

49. The process of claim 1 further comprising transporting a batch of beverage containers to the affixing station.

50. The batch separator and affixer of claim 15 further comprising means for conveying a batch of beverage containers to the affixing station.

* * * * *